US009126408B2

(12) United States Patent
Kanegae

(10) Patent No.: US 9,126,408 B2
(45) Date of Patent: Sep. 8, 2015

(54) LIQUID EJECTING HEAD UNIT AND LIQUID EJECTING APPARATUS

(71) Applicant: Seiko Epson Corporation, Tokyo (JP)

(72) Inventor: Takahiro Kanegae, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/302,789

(22) Filed: Jun. 12, 2014

(65) Prior Publication Data

US 2014/0368584 A1 Dec. 18, 2014

(30) Foreign Application Priority Data

Jun. 17, 2013 (JP) ..... 2013-126894

(51) Int. Cl.
*B41J 2/175* (2006.01)
*B41J 2/14* (2006.01)

(52) U.S. Cl.
CPC ..... *B41J 2/1433* (2013.01); *B41J 2/17513* (2013.01); *B41J 2/17596* (2013.01)

(58) Field of Classification Search
CPC ..... B41J 2/17; B41J 2/175; B41J 2/17513; B41J 2/17523; B41J 2/17553; B41J 2/17563; B41J 2/14
See application file for complete search history.

(56) References Cited

U.S. PATENT DOCUMENTS

| | | | | |
|---|---|---|---|---|
| 8,419,173 | B2 | 4/2013 | Hayashi et al. | |
| 2003/0151645 | A1 * | 8/2003 | Yamada et al. | 347/47 |
| 2008/0043059 | A1 | 2/2008 | Okazawa et al. | |
| 2010/0214379 | A1 | 8/2010 | Owaki et al. | |

FOREIGN PATENT DOCUMENTS

| | | | |
|---|---|---|---|
| JP | 2003-305873 | A | 10/2003 |
| JP | 2009-006730 | A | 1/2009 |

* cited by examiner

*Primary Examiner* — Geoffrey Mruk
(74) *Attorney, Agent, or Firm* — Harness, Dickey & Pierce, P.L.C.

(57) ABSTRACT

A liquid ejecting head unit includes a liquid ejecting head; an upstream flow path member that includes upstream flow paths; a downstream flow path member that includes downstream flow paths; and a seal member that includes pipe-shaped portions, which connect the upstream flow paths to the downstream flow paths and are provided with connecting flow paths through the inner portions of which a liquid flows, and is formed of an elastic material. The pipe-shaped portions are sealed due to inner walls thereof abutting at least one of the upstream flow path member and the downstream flow path member. The inner walls of the pipe-shaped portions include retaining portions that are provided along outer circumferences of the pipe-shaped portions so as to surround a region of the inner walls that abuts at least one of the upstream flow path member and the downstream flow path member.

18 Claims, 7 Drawing Sheets

LIQUID EJECTING HEAD UNIT AND LIQUID EJECTING APPARATUS

BACKGROUND

1. Technical Field

The present invention relates to a liquid ejecting head unit and a liquid ejecting apparatus that eject a liquid from nozzles; in particular, the invention relates to an ink jet recording head unit and an ink jet recording apparatus that discharge ink as the liquid.

2. Related Art

The ink jet recording head unit that discharges ink droplets is a representative example of the liquid ejecting head unit that ejects the liquid. As the ink jet recording head unit, there has been proposed (for example, refer to JP-A-2009-6730) an ink jet recording head unit that includes, for example, an ink jet recording head that discharges ink droplets from nozzles, and a flow path member that is fixed to the ink jet recording head and supplies ink from a liquid storage portion such as an ink cartridge that the ink is stored in, to a liquid ejecting head.

The flow path member of the ink jet recording head unit includes an upstream flow path member to which the ink from the liquid storage portion is supplied, and a downstream flow path member that holds the ink jet recording head and supplies the ink from the upstream flow path to the ink jet recording head. The flow path member is configured to interpose a seal member, which is formed of an elastic material of a plate shape such as a sheet, between the upstream flow path member and the downstream flow path member, and therefore be sealed such that the ink does not spill from the connected flow paths.

However, there are problems, in that when the flow path that is connected at the upstream flow path and the downstream flow path is to be sealed using a seal member formed of an elastic material such as a rubber sheet that is interposed between two members, a pressure is applied in a direction in which the upstream flow path member and the downstream flow path member separate from one another and a pressure is applied in a vertical direction to a liquid ejecting surface, through which the ink ejecting head discharges the ink droplets, due to a repulsive force caused by the elastic deformation of the seal member. This causes problems to occur, such as landing misalignment of the ink droplets to an ejecting target medium, caused by peeling between the flow path member and the liquid ejecting head, peeling of laminated members that constitute the liquid ejecting head, and warping of the liquid ejecting surface of the liquid ejecting head.

To deal with the problems described above, a configuration has been proposed in which the two flow paths are provided within a pipe-shaped portion, both of which are connected by a tube-shaped seal member, as disclosed in JP-A-2003-305873. However, there is a problem in that when the pressure with which the seal member abuts the pipe-shaped portion is low, the ink leaks out. There is also a problem in that, when fitting the tube-shaped seal member onto the pipe-shaped portion, the seal member stretches; thus, the sealing strength is reduced and the ink leaks out. Furthermore, there is a problem in that the ink also leaks out due to degradation of the tube-shaped seal member with the passage of time. Such leaking out of the ink occurs particularly due to the seal member expanding when the ink is supplied under pressure.

There is also a problem in that, irrespective of whether a plate-shaped or a tube-shaped seal member is used, when the upstream flow path member and the downstream flow path member are assembled, it is necessary to push the upstream flow path member relative to the downstream flow path member. There is a concern that a pressure will be applied in a direction in which the upstream flow path member and the downstream flow path member separate from one another due to the pushing.

On the other hand, there is a problem in that, when the pipe-shaped portion and the tube-shaped seal member are caused to be sealed by causing them to abut one another with a high pressure, the tube has to be fitted onto the pipe-shaped portion with a high pressure. Therefore, a problem occurs, such as a reduction in ease of assembly, and landing misalignment of the ink droplets caused by destruction of the liquid ejecting head or warping of the liquid ejecting surface due to a pressure being applied to the liquid ejecting head during the fitting.

Note that, the problems described above are not limited to the ink jet recording head unit, and are also present in a liquid ejecting head unit that ejects a liquid other than ink.

SUMMARY

An advantage of some aspects of the invention is to provide a liquid ejecting head unit and a liquid ejecting apparatus in which the flow path can be connected favorably and in which the ease of assembly is improved.

According to an aspect of the invention, there is provided a liquid ejecting head unit that includes a liquid ejecting head that discharges a liquid from nozzles by driving pressure generating units; an upstream flow path member that includes upstream flow paths to which a liquid is supplied from a liquid holding portion that holds the liquid; a downstream flow path member that includes downstream flow paths that communicate with the upstream flow paths of the upstream flow path member and supply the liquid to the liquid ejecting head; and a seal member that includes pipe-shaped portions, which connect the upstream flow paths of the upstream flow path member to the downstream flow paths of the downstream flow path member and are provided with connecting flow paths through the inner portions of which the liquid flows, and is formed of an elastic material. The pipe-shaped portions are sealed due to inner walls thereof abutting at least one of the upstream flow path member and the downstream flow path member. The inner walls of the pipe-shaped portions include retaining portions that are provided along outer circumferences of the pipe-shaped portions so as to surround a region of the inner walls that abuts at least one of the upstream flow path member and the downstream flow path member.

In this aspect, when the liquid within the upstream flow path and the downstream flow path is pressurized, the pipe-shaped portion of the seal member expands. However, since the retaining portions suppress the expansion of the pipe-shaped portion, a reduction in the adhesive force at the connecting portion between the connecting flow path and at least one of the upstream flow path and the downstream flow path is suppressed and it is possible to suppress the leaking out of the liquid. Since the retaining portions and the pipe-shaped portions are closely adhered to one another due to the liquid within the flow path being pressurized, when the retaining portions are disposed on the outer circumferences of the pipe-shaped portions, it is possible to suppress the application of a pressure in the lamination direction between the upstream flow path member and the downstream flow path member. Therefore, it is possible improve the ease of assembly, and to suppress the peeling or the destruction that is caused by stress being applied to the liquid ejecting head. Since the retaining portions and the pipe-shaped portions are closely adhered to one another due to the liquid within the flow path being pressurized and the leaking out of the pressurized liquid is suppressed, it is possible to reduce the adhesive pressure of the connecting portion between the pipe-shaped portion and at least one of the upstream flow path member and the downstream flow path member. Therefore, it is possible to further improve the ease of assembly and to suppress the stress during assembly.

Here, it is preferable that the region at which the retaining portions abut the pipe-shaped members be retained such that the liquid does not leak out from a connecting portion between the upstream flow path member and the downstream flow path member due to the liquid being pressurized within the connecting flow path. Accordingly, when the liquid within the upstream flow path and the downstream flow path is pressurized, the pipe-shaped portion of the seal member expands. However, since the retaining portions suppress the expansion of the pipe-shaped portion, a reduction in the adhesive force at the connecting portion between the connecting flow path and at least one of the upstream flow path and the downstream flow path is suppressed and it is possible to suppress the leaking out of the liquid. Since the retaining portions and the pipe-shaped portions are closely adhered to one another due to the liquid within the flow path being pressurized, when the retaining portions are disposed on the outer circumferences of the pipe-shaped portions, it is possible to suppress the application of a pressure in the lamination direction between the upstream flow path member and the downstream flow path member.

It is preferable that the upstream flow path member and the downstream flow path member be disposed within the connecting flow path with a gap opened therebetween, and that the retaining portion be provided to extend to an outer circumference that opposes the gap. Accordingly, it is possible to suppress the pushing in the lamination direction caused by the upstream flow path member abutting the downstream flow path member, and the retaining portion can suppress the expansion of the pipe-shaped portions.

It is preferable that the retaining portions be provided on a retaining member that is provided between the upstream flow path member and the downstream flow path member, and that the retaining member and the downstream flow path member be fixed to one another at different positions from those of the nozzles when projected onto a plane on which the nozzles of the liquid ejecting head are formed. Accordingly, it is possible to suppress the occurrence of peeling or destruction of the liquid ejecting head by suppressing the pushing of the periphery of the nozzles by the retaining portions when pressure is applied to the retaining portions.

It is preferable that the pipe-shaped portions be sealed due to the inner walls thereof abutting both of the upstream flow path member and the downstream flow path member, and that the retaining portion be continually provided across a region at which the pipe-shaped portion abuts the upstream flow path member and a region at which the pipe-shaped portion abuts the downstream flow path member. Accordingly, since it is possible to seal both the upstream flow path and the downstream flow path using one retaining portion, it is possible to reduce the number of parts and to reduce the costs.

Furthermore, according to another aspect of the invention, there is provided a liquid ejecting apparatus including the liquid ejecting head unit of the aspect described above.

In this aspect, it is possible to realize a liquid ejecting apparatus in which the ease of assembly is improved, the destruction of the parts is suppressed and the leaking of the liquid is suppressed.

It is preferable that the liquid ejecting apparatus further include a pump unit that pumps the liquid to the liquid ejecting head unit. Accordingly, it is possible to realize a liquid ejecting apparatus in which the leaking out of the pressurized liquid is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, detailed description will be given of the embodiments of the invention.

First Embodiment

Figure 1:
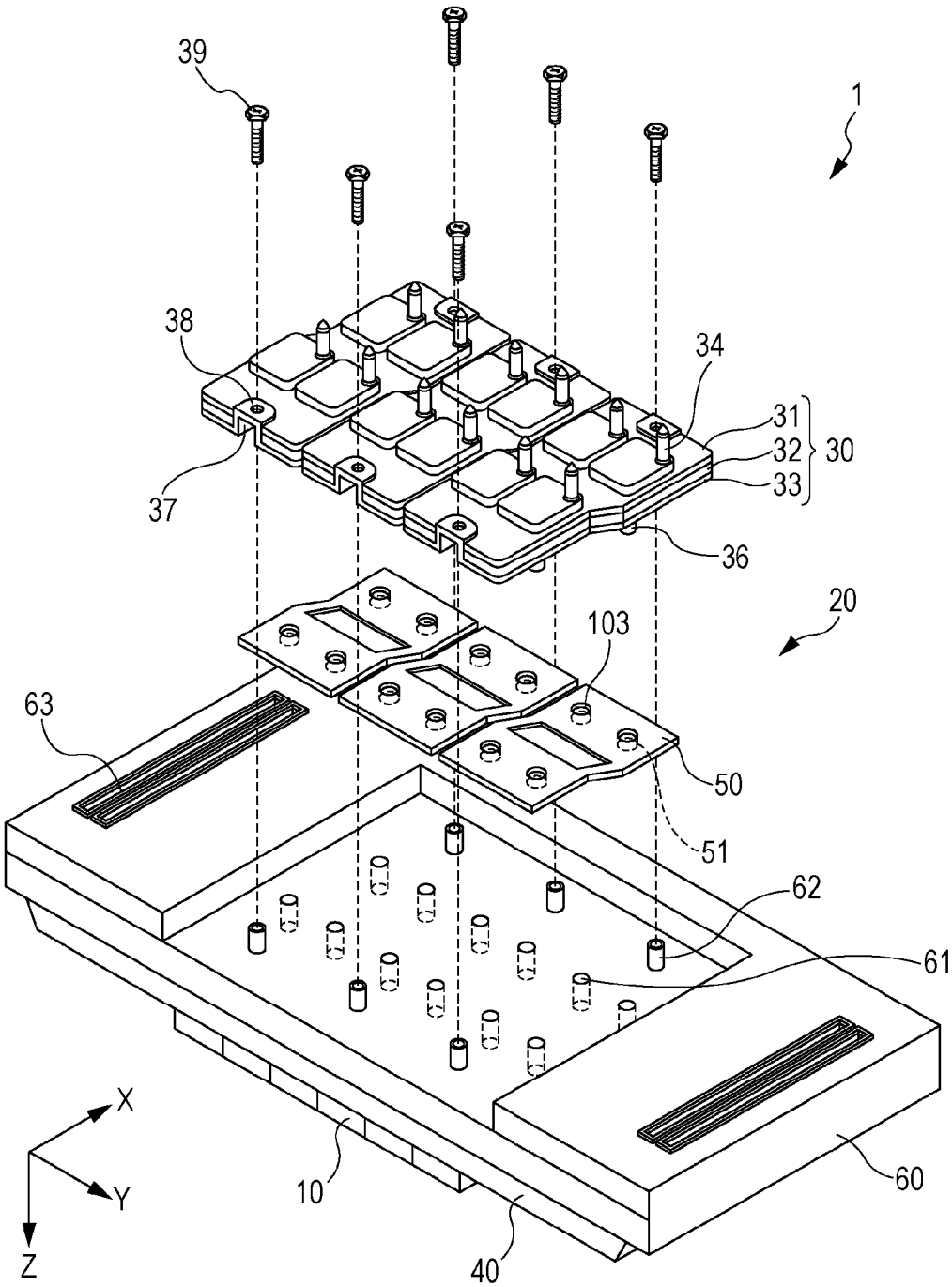
FIG. 1 is an exploded perspective view of a head unit according to a first embodiment of the invention.
Figure 2:
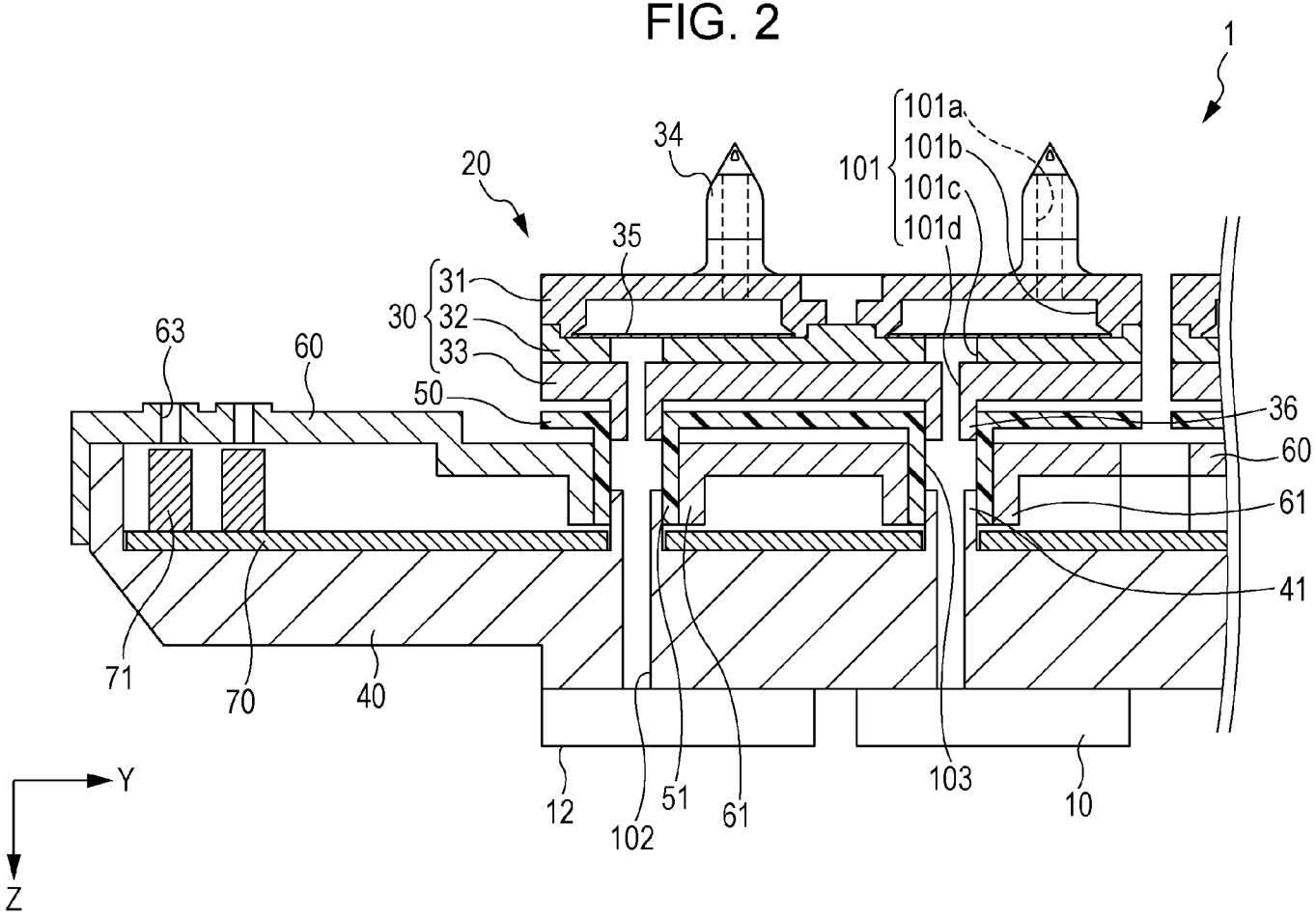
FIG. 2 is a cross-sectional view of the main components of the head unit according to the first embodiment of the invention.
Figure 3:
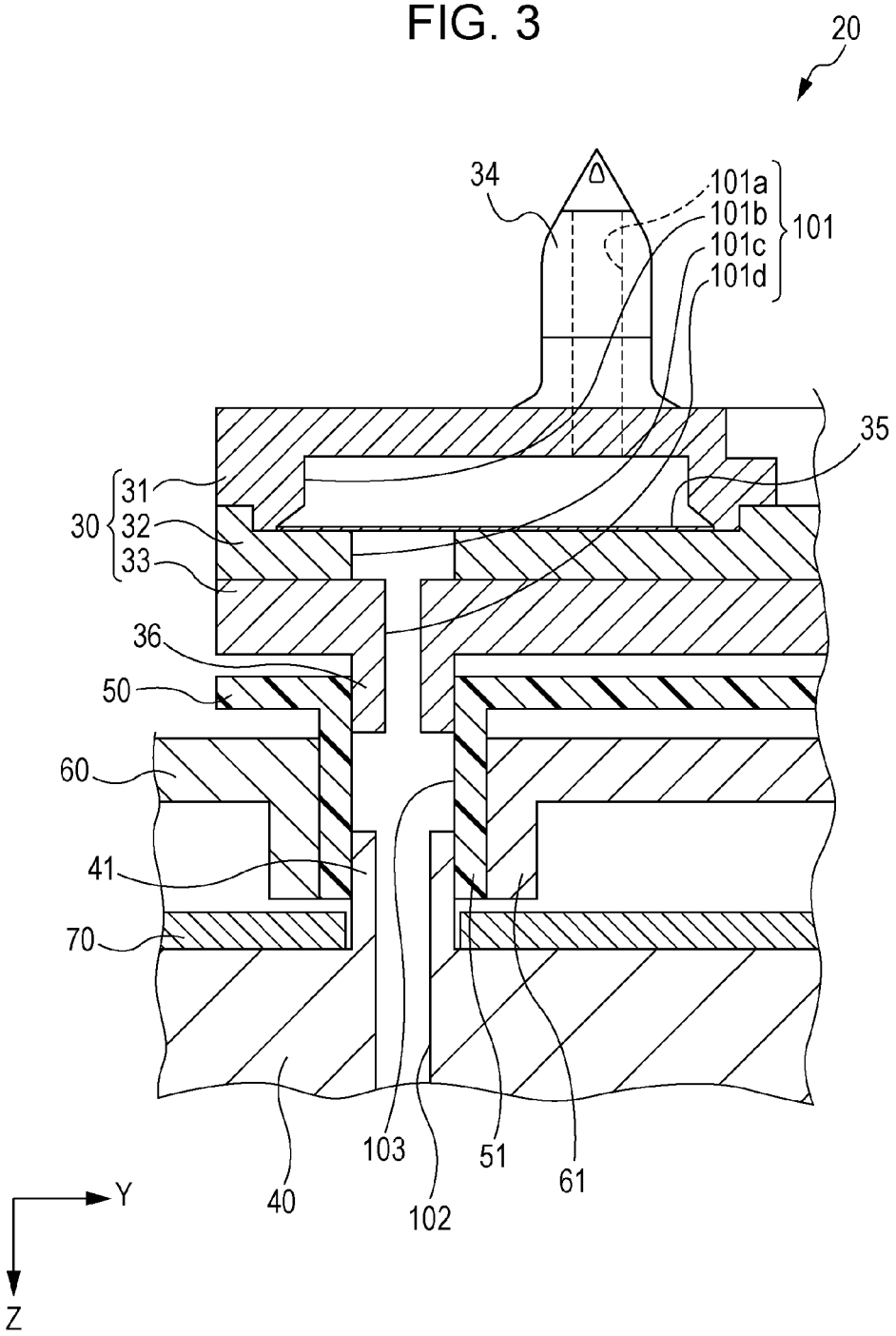
FIG. 3 is an enlarged cross-sectional view of the main components of the head unit according to the first embodiment of the invention.
Figure 4A:
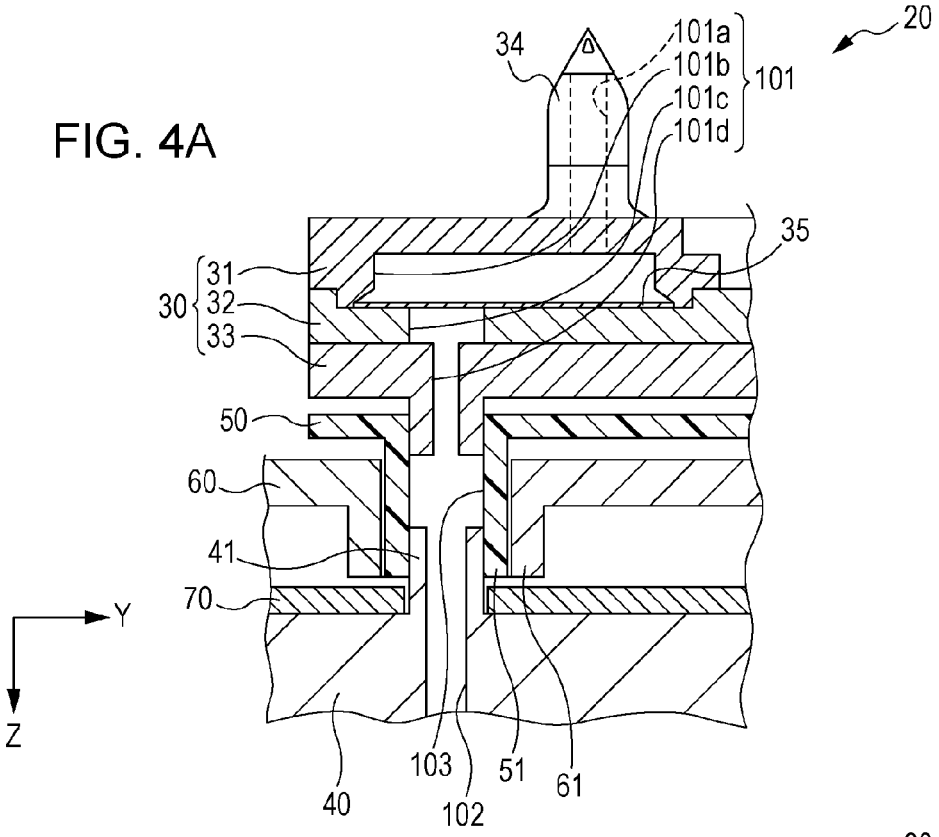
FIGS. 4A and 4B are cross-sectional views showing the state of the head unit according to the first embodiment of the invention.
Figure 4B:
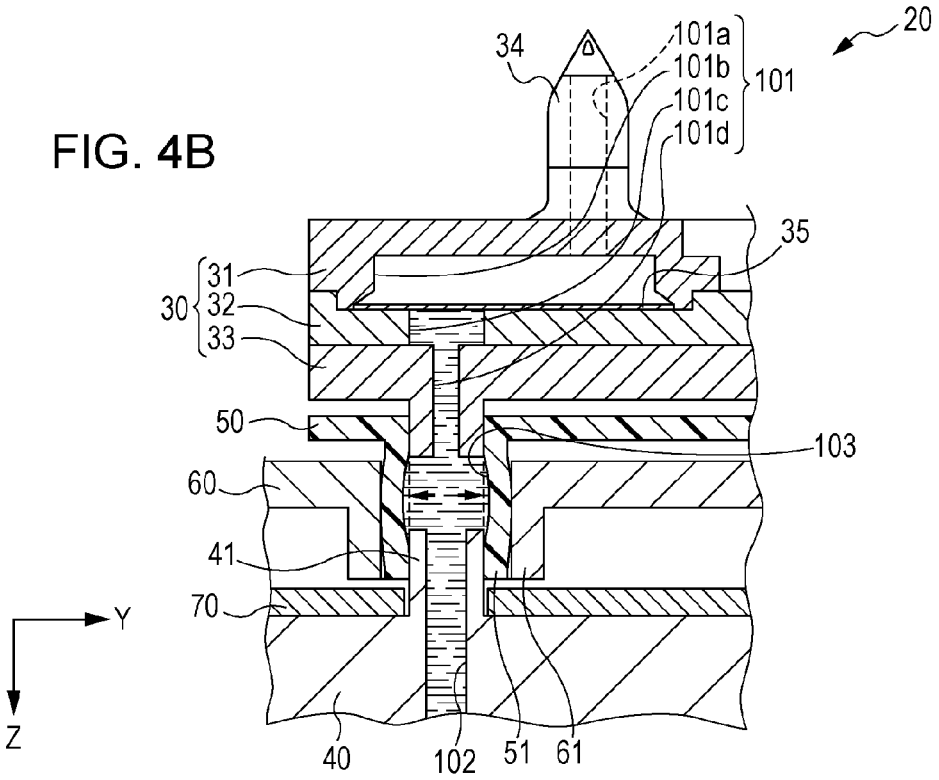

FIG. 1 is an exploded perspective view of an ink jet recording head unit, which is an example of the liquid ejecting head unit according to the first embodiment of the invention. FIG. 2 is a cross-sectional view of the ink jet recording head unit. FIG. 3 is an enlarged cross-sectional view of the main components of FIG. 2. FIGS. 4A and 4B are cross-sectional views showing the state of the ink jet recording head unit.

As shown in the drawings, an ink jet recording head unit 1 (hereinafter also referred to simply as the "head unit"), which is an example of the liquid ejecting head unit of this embodiment, includes a plurality of ink jet recording heads 10 (hereinafter also referred to simply as the "recording head 10") that discharge ink droplets from nozzles, and a flow path member 20 that holds the plurality of recording heads 10 and is provided with a liquid flow path that supplies the liquid to the recording head 10.

The recording head 10 is provided with, on one surface thereof, a liquid ejecting surface 12. The nozzles that eject the ink droplets as the liquid are opened in the liquid ejecting surface 12. In the liquid ejecting surface of this embodiment, while not particularly depicted in the drawings, two rows of nozzle rows, in which nozzles are provided in a line, are provided in a direction that intersects the direction in which the nozzles are lined up. Here, in this embodiment, the direction in which the nozzles in one nozzle row are lined up is referred to as a first direction X, and the direction, which intersects the first direction X, in which the nozzle rows are lined up is referred to as a second direction Y.

Flow paths that communicate with the nozzles and communicate with the liquid flow path of the flow path member 20, a pressure generating unit that generates a pressure change in the ink within the flow paths and the like are provided on an inner portion (not shown) of the recording head 10. Examples of a usable pressure generating unit include a unit that causes the ink droplets to be discharged from the nozzle by generating a pressure change in the ink within the flow path by causing the volume of the flow path to change due to the deformation of a piezoelectric actuator that includes a piezoelectric material that exhibits an electromechanical transduction function, a unit in which a heating element is disposed within the flow path and the ink droplets are caused to be discharged from the nozzle by the bubbles that are generated by the heating of the heating element, and a so-called electrostatic actuator, which generates static electricity between a diaphragm and an electrode and causes the ink droplets to be discharged from the nozzle by causing the diaphragm to be deformed using an electrostatic force.

An opposite surface side of the recording head 10 from the liquid ejecting surface 12 is fixed to the flow path member 20, and the ink that is held in a liquid holding portion such as an ink cartridge or an ink tank is supplied to the recording head 10 via the flow path member 20. There are a plurality of the recording heads 10 on the flow path member 20. In this embodiment, the recording heads 10 are provided in two rows of six so as to be lined up in the second direction Y, which is the direction in which the nozzle rows are lined up, with the rows separated from one another in the first direction X. In other words, in one of the head units 1, there are a total of 12 nozzles in the nozzle rows and the nozzles extend in the second direction Y. In this embodiment, the direction in which the flow path member 20 and the recording head 10 are fixed to one another is referred to as a third direction Z. In other words, the direction in which the flow path member 20 and the recording head 10 are fixed to one another refers to the lamination direction, and to the direction that is perpendicular to a planar direction (the directions within the plane of the first direction X and the second direction Y) of the liquid ejecting surface 12.

Incidentally, the method of fixing the recording head 10 and the flow path member 20 to one another is not particularly limited. For example, the method may be adhesion using an adhesive or fixing using a screw or the like. However, since the recording head 10 is compact and it is necessary to attach a plurality thereof to one of the flow path members 20, it is difficult to fix the recording heads 10 to the flow path member 20 via a seal member that is formed of an elastic material. Therefore, it is preferable that the recording head 10 and the flow path member 20 be adhered to one another using an adhesive.

The flow path member 20 to which the recording heads 10 are fixed includes an upstream flow path member 30, a downstream flow path member 40, a seal member 50 and a retaining member 60. The upstream flow path member 30 is provided with an upstream flow path 101 to which a liquid holding portion is connected, the downstream flow path member 40 is provided with a downstream flow path 102 that communicates with the upstream flow path 101, the seal member 50 is provided between the upstream flow path member and the downstream flow path member 40 to seal the connecting portion between the upstream flow path 101 and the downstream flow path 102, and the retaining member 60 includes a retaining portion 61 that retains the seal member 50. In other words, the liquid flow path of the flow path member 20 includes the upstream flow path 101 and the downstream flow path 102.

In this embodiment, the upstream flow path member 30 is configured by a first upstream flow path member 31, a second upstream flow path member 32 and a third upstream flow path member 33 being laminated in the third direction Z. The upstream flow path member 30 is not particularly limited thereto, and may be configured of a single member or a plurality of two or more members. The lamination direction of the plurality of members that configure the upstream flow path member 30 is also not particularly limited, and may be the first direction X or the second direction Y.

A surface of the first upstream flow path member 31 of the opposite side from the downstream flow path member 40 includes a connecting portion 34 to which the liquid holding portion that holds the ink (the liquid) is connected. In this embodiment, a protruding needle-shaped portion that is connected to the liquid holding portion is adopted as the connecting portion 34. The liquid holding portion such as an ink cartridge may be directly connected to the connecting portion 34. In addition, the liquid holding portion such as an ink tank may be connected to the connecting portion 34 via a supply pipe such as a tube. The inner portion of the connecting portion 34 is provided with a first upstream flow path 101*a*, through which the ink from the liquid holding portion is supplied. The downstream side of the first upstream flow path 101*a* includes a liquid collecting portion 101*b* with a wider inner diameter than that of the first upstream flow path 101*a* within the connecting portion 34.

The second upstream flow path member 32 is fixed to the opposite surface side of the first upstream flow path member 31 from the connecting portion 34 and includes a second upstream flow path 101*c* that communicates with the first upstream flow path 101*a*. A filter 35 for removing bubbles and foreign objects contained in the ink is provided on an opening portion of the second upstream flow path 101*c* of the second upstream flow path member 32. The ink that is supplied from the first upstream flow path 101*a* (the liquid collecting portion 101*b*) is supplied to the second upstream flow path 101*c* via the filter 35. Depending on the position between the first upstream flow path 101*a* and a third upstream flow path 101*d* (described hereinafter), the second upstream flow path 101*c* may be either a flow path that extends in the third direction Z, which is the lamination direction of the first upstream flow path member 31 and the second upstream flow path member 32, or a flow path that extends in a direction perpendicular to the third direction Z, that is, within the plane that includes the first direction X and the second direction Y.

The third upstream flow path member 33 is provided on the opposite side of the second upstream flow path member from the first upstream flow path member 31. A third upstream flow path 101*d*, which communicates with the second upstream flow path 101*c* of the second upstream flow path member 32, is provided on the third upstream flow path member 33. In other words, the upstream flow path 101 includes the first upstream flow path 101*a* (a liquid collecting portion 101*b*), the second upstream flow path 101*c* and the third upstream flow path 101*d*. One end of the third upstream flow path 101*d* is open to the second upstream flow path member 32 side to communicate with the second upstream flow path 101*c*. The other end of the third upstream flow path 101*d* is provided to be open to a tip end surface of a cylindrically-shaped first protruding portion 36 that is provided to protrude to the downstream flow path member 40 side. In other words, a plurality of the pipe-shaped first protruding portions 36, each of which has the upstream flow path 101 provided on the inner portion thereof, are provided on the surface of the downstream flow path member 40 side of the upstream flow path member 30 so as to protrude. Note that, in this embodiment, the first protruding portion 36 that has a cylindrical shape is provided. Naturally, the internal shape of the first protruding portion 36, that is, the cross-sectional shape of the upstream flow path 101, the external shape (the cross-sectional shape) of the first protruding portion 36 or the like is not limited to a circular shape, and may be an elliptical shape, a rectangular shape or the like.

The first upstream flow path member 31, the second upstream flow path member 32 and the third upstream flow path member 33, which are provided with the upstream flow path 101, are laminated integrally using, for example, an adhesive, welding or the like. While it is possible to fix the first upstream flow path member 31, the second upstream flow path member 32 and the third upstream flow path member 33 using screws, clamps or the like, it is preferable that they be bonded using an adhesive, welding or the like in order to suppress the leaking out of the ink (the liquid) from the connecting portion from the first upstream flow path 101*a* to the third upstream flow path 101*d*.

A concave portion 37 that is open to the downstream flow path member 40 side is provided on the third upstream flow path member 33. Fixing holes 38 that penetrate in the thickness direction are provided on the bottom surface of the concave portion 37, that is, on the surface of the first upstream flow path member 31 side. Fixing portions 62 (described in detail hereinafter) are provided on the retaining member 60 and are provided to protrude to the upstream flow path member 30 side. The fixing portion 62 is inserted inside the concave portion 37, a fixing screw 39 is inserted into the fixing hole 38 and caused to screw into the fixing portion 62; thus, the upstream flow path member 30 is fixed to one surface of the retaining member 60.

Note that, in this embodiment, four of the connecting portions 34 are provided for one of the upstream flow path members 30, and four of the independent upstream flow paths 101 are provided for one of the upstream flow path members 30. In this embodiment, a configuration is exemplified in which four of the independent upstream flow paths 101 are provided for one of the upstream flow path members 30; however, the invention is not particularly limited thereto. For example, after passing through the filter 35 from the connecting portion 34 side, the upstream flow path 101 may branch into two. Naturally, after passing through the filter 35, the upstream flow path 101 may branch into three or more. Two fixing holes 38 are provided in one of the upstream flow path members 30, and the upstream flow path member 30 is fixed to the retaining member 60 at two locations using the fixing screws 39. In this embodiment, three of the upstream flow path members 30 are provided for one of the head units 1. Naturally, the fixing method of fixing the upstream flow path member 30 to the retaining member 60 is not limited to fastening using screws. For example, adhering using an adhesive or the like may be adopted as the fixing method. In this embodiment, by fixing the upstream flow path member 30 to the retaining member 60 using the fixing screws 39, it is possible to easily attach and remove the upstream flow path member 30 to and from the retaining member 60. Therefore, it is possible to exchange only the upstream flow path member 30, and to improve the yield in comparison to when the entirety of the flow path member 20 is exchanged. Since it is possible to easily attach and remove the upstream flow path member 30 to and from the retaining member 60, it is possible to easily perform backwashing, in which a cleaning solution is caused to flow backward in the upstream flow path 101 of the upstream flow path member 30, and foreign objects within the upstream flow path 101 or on the filter 35 are washed out.

The retaining member 60 is a member in which the upstream flow path member 30 is fixed to one surface thereof in the third direction Z and the downstream flow path member 40 is fixed to the other surface side. The seal member 50, which is a join, that connects (joins) the upstream flow path 101 of the upstream flow path member 30 to the downstream flow path 102 of the downstream flow path member is provided between the retaining member 60 and the upstream flow path member 30.

Here, the downstream flow path member 40 is fixed to the opposite side of the retaining member 60 from the upstream flow path member 30. Furthermore, the recording head 10 is fixed to the opposite surface side of the downstream flow path member 40 from the retaining member 60.

The downstream flow path member 40 is provided with a downstream flow path 102 that communicates with the upstream flow path 101 of the upstream flow path member 30. The downstream flow path 102 is provided such that one end thereof is open to a surface that is fixed to the recording head 10, and the other end is open to a tip end surface of a cylindrically-shaped second protruding portion 41 that is provided to protrude to the upstream flow path member 30 side. In other words, a plurality of the pipe-shaped second protruding portions 41, each of which has the downstream flow path 102 provided on the inner portion thereof, are provided on the surface of the upstream flow path member 30 side of the downstream flow path member 40 so as to protrude. Note that, in this embodiment, the second protruding portion 41 that has a cylindrical shape is provided. Naturally, the internal shape of the second protruding portion 41, that is, the cross-sectional shape of the downstream flow path 102, the external shape (the cross-sectional shape) of the second protruding portion 41 or the like is not limited to a circular shape, and may be an elliptical shape, a rectangular shape or the like.

The upstream flow path 101 that is provided on the first protruding portion 36 of the upstream flow path member 30 and the downstream flow path 102 that is provided on the second protruding portion 41 of the downstream flow path member 40 are sealed and connected by the seal member 50. The first protruding portion 36 and the second protruding portion 41 are disposed such that the opposing tip end surfaces thereof are a predetermined interval apart. Incidentally, when the tip end surfaces of the first protruding portion 36 and the second protruding portion 41 are caused to directly contact one another, due to dimensional tolerance and the like, a gap forms between the first protruding portion 36 and the second protruding portion 41, or, the first protruding portion 36 abuts the second protruding portion 41 and a pressure is applied to the recording head 10 in the third direction Z. Accordingly, by disposing the tip end surface of the first protruding portion 36 and the tip end surface of the second protruding portion 41 in separated positions in advance, it becomes difficult for the first protruding portion 36 to push the second protruding portion 41 and a pressure to be applied to the recording head 10 in the third direction Z. When there is a gap between the first protruding portion 36 and the second protruding portion 41, there is a concern that bubbles will be retained. Accordingly, the space between the first protruding portion 36 and the second protruding portion 41 may be filled with a filling member. For the filling member, it is possible to use a material, which is a porous elastic body that is liquid resistant in relation to the liquid such as the ink that is used in the head unit 1, and has a low elastic force (modulus of elasticity) in comparison with the seal member 50. For example, examples of the porous elastic body include resin materials such as polyethylene, melamine, and sponge formed of rubber or the like.

For the seal member 50, it is possible to use an elastically deformable material (an elastic member) that is liquid resistant in relation to the liquid such as the ink that is used in the head unit 1; for example, rubber or an elastomer.

The seal member 50 includes a pipe-shaped (tube-shaped) pipe-shaped portion 51 for each region that connects the upstream flow path 101 to the downstream flow path 102. The inner portion of the pipe-shaped portion 51 is provided with a connecting flow path 103 that has a slightly smaller internal diameter than that of the first protruding portion and the second protruding portion 41. By fitting the connecting flow path 103 of the pipe-shaped portion 51 across the outer circumferences of the first protruding portion 36 and the second protruding portion 41, the upstream flow path 101 that is provided on the first protruding portion 36 and the downstream flow path 102 that is provided on the second protruding portion 41 are caused to communicate with one another via the connecting flow path 103. In other words, the pipe-shaped portion 51 is provided on the outer circumferences of the first protruding portion 36 and the second protruding portion 41 across the outer circumferences of the first protruding portion 36 and the second protruding portion 41, so as to continue across the circumferential direction of the boundary. In this embodiment, since the first protruding portion 36 and the second protruding portion 41 have circular-shaped external cross-sections, the pipe-shaped portion 51 has a circular-shaped cross-sectional inner portion so as to fit the outer circumferences of the first protruding portion 36 and the second protruding portion 41 and the thickness of the pipe-shaped portion 51 is substantially the same across the circumferential direction; that is, the pipe-shaped portion 51 is cylindrically shaped. The pipe-shaped portions 51 are connected by a plate-shaped portion on the upstream flow path member 30 side such that a plurality thereof are integral in relation to one of the upstream flow path members 30. In this embodiment, since four upstream flow paths are provided for one of the upstream flow path members 30, the seal member 50 is integrally provided with four of the pipe-shaped portions 51. Furthermore, in this embodiment, since three of the upstream flow path members 30 are provided for one of the flow path members 20, the same number of the seal members 50 are provided as there are upstream flow path members 30, that is, three.

Since the connecting flow path 103 has an inner diameter that is slightly smaller than the outer circumferences of the first protruding portion 36 and the second protruding portion 41, the inner surface of the connecting flow path 103 is closely adhered to the outer circumferential surfaces of the first protruding portion 36 and the second protruding portion 41 in a state in which pressure is applied in a radial direction of the upstream flow path 101 and the downstream flow path 102. Incidentally, the radial direction of the upstream flow path 101 and the downstream flow path 102 is a direction that crosses the direction in which the ink flows. In this embodiment, the radial direction refers to the intra-surface directions of the first direction X and the second direction Y. Incidentally, in this embodiment, the upstream flow path 101 and the downstream flow path 102 are provided along the third direction Z; however, the invention is not particularly limited thereto. For example, one or both of the upstream flow path 101 and the downstream flow path 102 may be provided in a direction that intersects the third direction Z. In this case, in the seal member 50, the radial direction of the upstream flow path 101 and the downstream flow path 102 is a direction that intersects the third direction Z in which the flow paths are provided.

In this manner, the upstream flow path 101 and the downstream flow path 102 are caused to communicate with one another using the seal member 50 that seals the upstream flow path 101 and the downstream flow path 102 by applying a pressure in the radial direction thereof. Therefore, the seal member 50 elastically deforms in a direction perpendicular to the surface direction of the liquid ejecting surface 12 on which the nozzles are formed, that is, in the third direction Z, and it is possible to suppress the pushing of the recording head 10 by the repulsive force from the elastic deformation. Accordingly, it is possible to suppress the occurrence of peeling of the recording head 10 from the flow path member 20, peeling of the laminated members (members that are laminated in the third direction Z, not shown) that configure the recording head 10, and warping of the liquid ejecting surface 12 of the recording head 10, and to suppress landing misalignment of the ink droplets, which are discharged from the nozzles, to the ejecting target medium caused by the warping of the liquid ejecting surface 12 on which the nozzles are formed.

Incidentally, when the seal member 50 that is formed of an elastic member is interposed between the tip end surface of the first protruding portion 36 and the tip end surface of the second protruding portion 41, a pressure is applied to the recording head 10 in the third direction Z due to a repulsive force caused by the elastic deformation of the seal member 50. When a pressure is applied to the recording head 10 in the third direction Z, landing misalignment of the ink droplets to the ejecting target medium occurs due to peeling of the recording head 10 from the flow path member 20, peeling of the laminated members (members that are laminated in the third direction Z, not shown) that configure the recording head 10, and warping of the liquid ejecting surface 12 of the recording head 10.

In this embodiment, the upstream flow path member 30 and the downstream flow path member 40 are fixed to each surface of the retaining member 60 in the third direction Z, respectively.

The retaining member 60 includes the retaining portions 61 that have a cylindrical shape and are provided to correspond to each of the pipe-shaped portions 51 of the seal member 50.

The retaining portions 61 are provided along the outer circumferences of the pipe-shaped portions 51 so as to surround a region at which the inner walls of the pipe-shaped portions 51 abut at least one of the upstream flow path member 30 and the downstream flow path member 40. In this embodiment, the retaining portions 61 are provided along the outer circumferences of the pipe-shaped portions 51 so as to surround a region at which the inner walls of the pipe-shaped portions 51 abut the downstream flow path member 40. The retaining portion 61 has an internal diameter that is either the same as or slightly larger than the outer diameter of the pipe-shaped portion 51. In this embodiment, the retaining portions 61 are provided across the circumferential direction of the outer circumferences of the pipe-shaped portions 51, and the inner surfaces of the retaining portions 61 are disposed in a state of contacting or not contacting the outer circumferences of the pipe-shaped portions 51. In this embodiment, "the inner surface of the retaining portion 61 is contacting the outer circumference of the pipe-shaped portion 51" refers to a state in which, rather than the entire inner surface of the retaining portion 61 abutting the outer circumference of the pipe-shaped portion 51, only a portion is abutting in the region at which the retaining portion 61 opposes the pipe-shaped portion 51. In other words, the inner circumferential surface of the retaining portion 61 and the outer circumferential surface of the pipe-shaped portion 51 are disposed in a state in which the two are not closely adhered by applying pressure to one another.

In this embodiment, the retaining portion 61 is provided on the outside of a region of the second protruding portion 41 of the downstream flow path member 40 to which the pipe-shaped portion 51 is fitted. The retaining portion 61 is provided to extend such that the retaining portion 61 and the outside of the pipe-shaped portion 51, which covers the gap between the first protruding portion 36 and the second protruding portion 41, oppose one another.

The retaining portion 61 is closely adhered to the outer circumferential surface of the pipe-shaped portion 51, that is, the two abut one another with a predetermined pressure due to the ink within the upstream flow path 101, the connecting flow path 103 and the downstream flow path 102 being pressurized.

Specifically, in a state in which the ink is not pressurized, in this embodiment, a state in which the ink is not being supplied to the flow path member 20, as shown in FIG. 4A, the retaining portion 61 contacts or does not contact the outer circumferential surface of the pipe-shaped portion 51. In other words, the inner circumferential surface of the retaining portion 61 and the outer circumferential surface of the pipe-shaped portion 51 are in contact (not in contact) with one another in a state in which pressure is not applied.

As shown in FIG. 4B, when the ink within the flow path of the flow path member 20 is pressurized, the pipe-shaped portion 51 of the seal member 50 expands due to the pressurized ink. In particular, the pipe-shaped portion 51, which covers the space between the first protruding portion 36 and the second protruding portion 41, that is, a region in which the tip end surfaces of the first protruding portion 36 and the second protruding portion 41 oppose one another, expands. Accordingly, the outer diameter of the pipe-shaped portion 51 becomes larger, and the inner circumferential surface of the retaining portion 61 and the outer circumferential surface of the pipe-shaped portion 51 are closely adhered to one another, that is, abut one another with a high pressure in a direction perpendicular to the third direction Z. In other words, the retaining portion 61 restricts the expansion of the pipe-shaped portion 51 due to the ink being pressurized, and suppresses the expansion of the pipe-shaped portion 51. Since the retaining portion 61 suppresses the expansion of the pipe-shaped portion 51, it is possible to suppress a reduction in the pressure between the inner surface of the pipe-shaped portion 51 and outer surface of the second protruding portion 41 that is caused by contraction of the ink and to suppress the leaking out of the ink from the connecting portion between the connecting flow path 103 and the downstream flow path 102. When fitting the pipe-shaped portion 51 of the seal member 50 onto the second protruding portion 41 or the like, even if the sealing strength (the adhesive force) is reduced due to the pipe-shaped portion 51 stretching, since the pipe-shaped portion 51 and the retaining portion 61 are closely adhered to one another with high pressure due to the pressurized ink, it is possible to suppress a reduction in the pressure of the close adhesion between the inner surface of the pipe-shaped portion 51 and outer surface the second protruding portion 41 and to suppress the leaking out of the ink from the connecting portion between the connecting flow path 103 and the downstream flow path 102. Furthermore, even if the adhesive force between the pipe-shaped portion 51 and the second protruding portion 41 is reduced by contraction due to the degradation of the pipe-shaped portion 51 with the passage of time, since the pipe-shaped portion 51 and the retaining portion 61 are closely adhered to one another with a high pressure due to the pressurized ink, it is possible to suppress the leaking out of the ink.

In this manner, in this embodiment, the pipe-shaped portion 51 and the retaining portion 61 are closely adhered to one another with a high pressure due to the pressurization of the ink, and the pipe-shaped portion 51 is fastened by the retaining portion 61. Accordingly, in a state in which the ink is not pressurized, it is possible to lower the adhesive force between the pipe-shaped portion 51 and the second protruding portion 41. Accordingly, it is possible to reduce the pressure when causing the pipe-shaped portion 51 to fit onto the outer circumference of the second protruding portion 41 during the assembly of the flow path member 20. In other words, when the retaining portion 61 is not provided, the leaking out of the ink may not be suppressed when the ink is pressurized unless the pressure of the close adhesion between the pipe-shaped portion 51 and the second protruding portion 41 is set to be high. However, when the pressure of the close adhesion between the pipe-shaped portion 51 and the second protruding portion 41 is set to be high, the ease of assembly is reduced and a high pressure is applied in the third direction Z when fitting the pipe-shaped portion 51 onto the outer circumference of the second protruding portion 41. The pressure in the third direction Z is transmitted to the recording head 10 via the downstream flow path member 40. In this embodiment, since the pipe-shaped portion 51 and the second protruding portion 41 are closely adhered to one another with a low pressure, it is possible to reduce the pressure that is applied in the third direction Z when fitting the pipe-shaped portion 51 onto the outer circumference of the second protruding portion 41. Therefore, it is possible to improve the ease of assembly, and to suppress the peeling or the destruction of the recording head 10 that is caused by the pressure in the third direction Z during assembly. As described above, even if the pipe-shaped portion 51 and the second protruding portion 41 are caused to closely adhere to one another with a low pressure, it is possible to suppress the leaking out of the ink from the connecting portion when the ink is pressurized.

In this embodiment, in a state in which the ink is not pressurized, the inner circumferential surface of the retaining portion 61 and the outer circumferential surface of the pipe-shaped portion 51 are not closely adhered to one another. Accordingly, it is possible to reduce the pressure that is applied in the third direction Z when fitting the retaining portion 61 onto the outer circumference of the pipe-shaped portion 51. Incidentally, when the pipe-shaped portion 51 and the second protruding portion 41 are caused to closely adhere to one another with a high pressure, the adhesive pressure may be set to be high such that the outer circumference of the pipe-shaped portion 51 is fastened by the retaining portion 61. However, a high pressure is applied in the third direction Z during assembly, that is, when fitting the retaining portion 61 onto the outer circumference of the pipe-shaped portion 51. In this embodiment, it is possible to reduce the pressure that is applied in the third direction Z when fitting the retaining portion 61 onto the outer circumference of the pipe-shaped portion 51. Accordingly, it is possible to improve the ease of assembly. In other words, in this embodiment, since a plurality of the pipe-shaped portions 51 are provided integrally in the seal member 50, it is difficult to fit a plurality of the pipe-shaped portions 51 into a plurality of the second protruding portions 41 at the same time with a high pressure. Similarly, this is because it is difficult to fit a plurality of the retaining portions 61 onto a plurality of the pipe-shaped portions 51 at the same time with a high pressure. When the retaining portion 61 is fitted onto the outer circumference of the pipe-shaped portion 51, since it is possible to reduce the pressure that is applied in the third direction Z, it is possible to suppress the pressure that is applied to the recording head 10 via the downstream flow path member 40 and to suppress the peeling and the destruction of the recording head 10.

Incidentally, the pressurization of the ink within the flow path may be performed using a pressurization pump that is provided on the liquid holding portion side, or, by using a hydraulic head difference between the liquid holding portion and the head unit 1.

The retaining member 60, which includes the retaining portions 61, and the downstream flow path member 40 are fixed to one another in a different region from that of the downstream flow path member 40 in which the recording head 10 is held within a plane that containing the first direction X and the second direction Y. In other words, the retaining member 60 and the downstream flow path member 40 are fixed to one another in a region in which the projections thereof do not overlap. In this embodiment, the retaining portion 61 of the retaining member 60 and the downstream flow path member 40 are disposed so as to not contact one another in the third direction Z.

It is preferable that the position at which the downstream flow path member 40 and the retaining member 60 are fixed to one another be a different position from the nozzles when projected onto a plane in which the nozzles are formed. This is because, by setting the region in which the downstream flow path member 40 and the retaining member 60 are fixed to one another to be a different position from that of the nozzles, when, for example, a pressure is applied to the retaining portion 61 in the third direction Z, the retaining portion 61 pushes the downstream flow path member 40 and it is possible to suppress the application of pressure to the recording head 10.

In this embodiment, a wiring substrate 70 is further provided between the downstream flow path member 40 and the retaining member 60. While not particularly shown in the drawings, the wiring substrate 70 is provided with wiring that is connected to a pressure generating unit or the like that is provided on the recording head 10. A connector 71 is provided on the wiring substrate 70. External wiring (not shown), which is inserted through a wiring connection hole 63 that is provided on the retaining member 60, is connected to the connector 71. When the wiring substrate 70 is provided within the flow path member 20 in this manner, since the wiring becomes short circuited when the wiring substrate 70 contacts the ink, it is necessary to suppress the leaking out of the ink (the liquid) from the connecting portion between the upstream flow path 101 and the downstream flow path 102, in particular. In this embodiment, since the connecting portion between the upstream flow path 101 and the downstream flow path 102 is sealed using the seal member 50 and the retaining portion 61 is provided, it is possible to seal the connecting portion between the upstream flow path 101 and the downstream flow path 102 with a high pressure in a state in which the pressure applied to the recording head 10 in the third direction Z is suppressed.

In this manner, the upstream flow path 101 and the downstream flow path 102 are caused to communicate with one another using the seal member 50 that seals the upstream flow path 101 and the downstream flow path 102 by applying a pressure in the radial direction thereof. Therefore, the seal member 50 elastically deforms in a direction perpendicular to the surface direction of the liquid ejecting surface 12, that is, in the third direction Z, and it is possible to suppress the pushing of the recording head by the repulsive force from the elastic deformation. Accordingly, it is possible to suppress the occurrence of peeling of the recording head 10 from the flow path member 20, peeling of the laminated members (members that are laminated in the third direction Z, not shown) that configure the recording head 10, and warping of the liquid ejecting surface 12 of the recording head 10, and to suppress landing misalignment of the ink droplets, which are discharged from the nozzles, to the ejecting target medium caused by the warping of the liquid ejecting surface 12.

The retaining portion 61, which retains the outside of the pipe-shaped portion 51 that opposes the second protruding portion 41 and the outside of the pipe-shaped portion 51 in the region between the first protruding portion 36 and the second protruding portion 41, is provided on the outer circumference of the pipe-shaped portion 51 of the seal member 50. The retaining portion 61 is configured to suppress a reduction in the adhering force between the pipe-shaped portion 51 and the second protruding portion 41, where the reduction is caused by the pipe-shaped portion 51 expanding due to the ink within the flow path being pressurized and the inner circumferential surface of the retaining portion 61 and the inner circumferential surface of the pipe-shaped portion 51 being closely adhered to one another. Therefore, when the ink is pressurized, it is possible to suppress the leaking out of the ink. In a state in which the ink is not pressurized, it is possible to lower the pressure of the close adhesion between the pipe-shaped portion 51 and the second protruding portion 41 and the pressure of the close adhesion between the pipe-shaped portion 51 and the retaining portion 61. Therefore, it is possible to improve the ease of assembly and to suppress the application of a pressure in the third direction Z during assembly.

Second Embodiment

Figure 5:
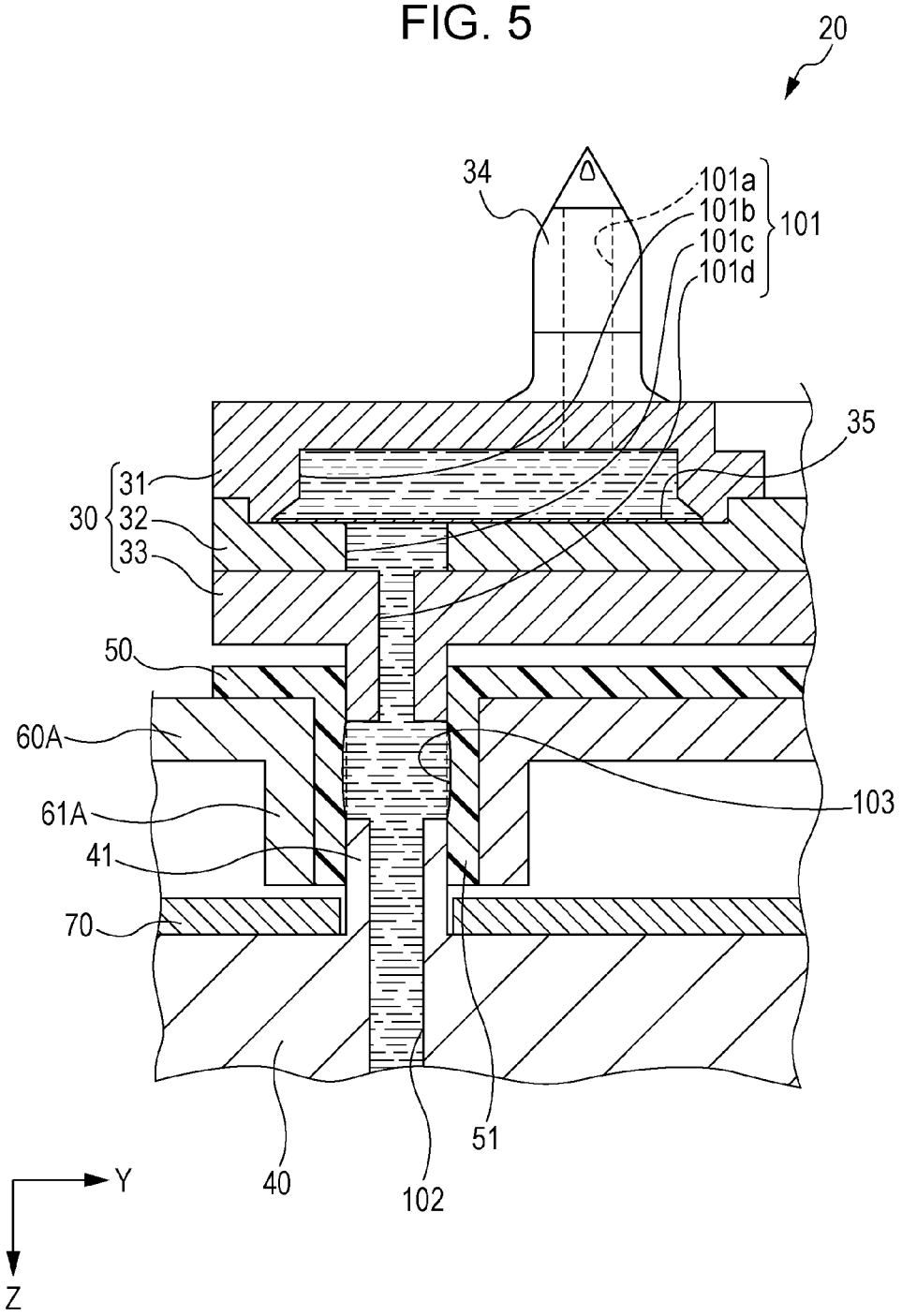
FIG. 5 is an enlarged cross-sectional view of the main components of the head unit according to a second embodiment of the invention.

FIG. 5 is an enlarged cross-sectional view of the main components of an ink jet recording head unit, which is an example of the liquid ejecting head unit according to the second embodiment of the invention. Note that members which are the same as those in the first embodiment described above are assigned identical reference signs and numerals, and redundant descriptions will be omitted.

As shown in FIG. 5, a retaining portion 61A that is provided on a retaining member 60A is provided on the outer circumference of the pipe-shaped portion 51 of the seal member 50 to continue in a circumferential direction from a region in which the retaining portion 61A and the first protruding portion 36 oppose one another to a region in which the retaining portion 61A and the second protruding portion 41 oppose one another.

Note that, in the same manner as in the first embodiment described above, in a state in which the ink is not pressurized, the retaining portion 61A and the pipe-shaped portion 51 are in contact or not in contact with one another, and the outer circumferential surface of the pipe-shaped portion 51 and the inner circumferential surface of the retaining portion 61A are closely adhered to one another due to the ink being pressurized.

In this embodiment, since the retaining portion 61A is provided on the outer circumference of the pipe-shaped portion 51 astride a region that opposes the first protruding portion 36 and the second protruding portion 41, when the ink is pressurized, it is possible to suppress the leaking out of the ink of the connecting portion between the upstream flow path 101 and the connecting flow path 103 and of the connecting portion between the connecting flow path 103 and the downstream flow path 102 using the retaining portion 61A. In comparison to a case in which the retaining portion 61 which is the same as that of the first embodiment described above is also provided on the connecting portion between the upstream flow path 101 and the connecting flow path 103, it is possible to suppress the leaking out of the ink of the connecting portion between the upstream flow path 101 and the connecting flow path 103 and of the connecting portion between the connecting flow path 103 and the downstream flow path 102 using one of the retaining portions 61A. Therefore, it is possible to reduce the number of parts and to suppress costs.

In this embodiment, the retaining member 60A and a plate-shaped portion of the seal member 50 are provided to abut one another; however, if the plate-shaped portion and the upstream flow path member 30 do not abut one another to form a gap, it is possible to suppress the pressure that is applied to the retaining member 60A via the seal member 50 when the upstream flow path member 30 is fixed to the retaining member 60A.

Third Embodiment

Figure 6:
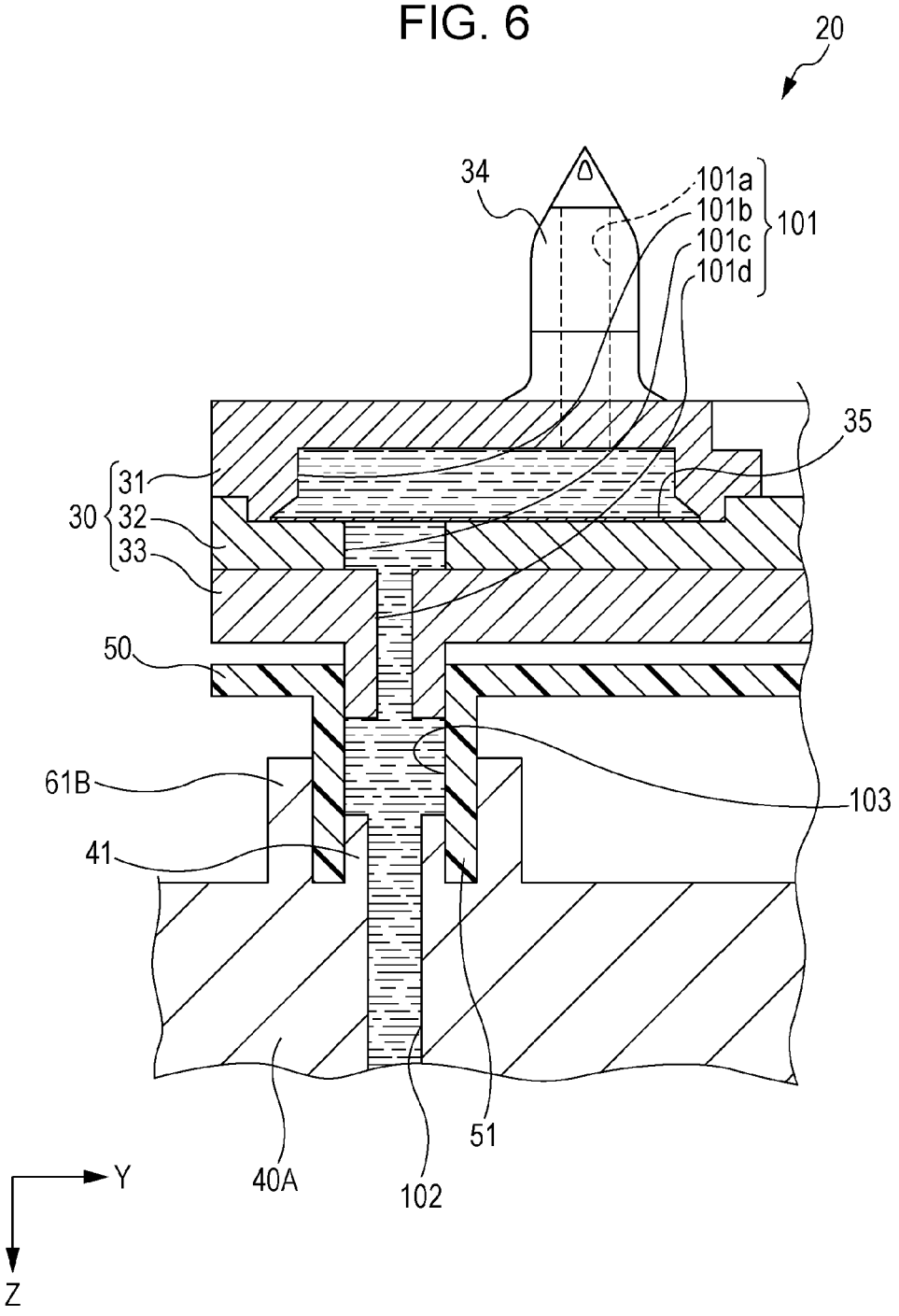
FIG. 6 is an enlarged cross-sectional view of the main components of the head unit according to a third embodiment of the invention.

FIG. 6 is an enlarged cross-sectional view of the main components of an ink jet recording head unit, which is an example of the liquid ejecting head unit according to the third embodiment of the invention. Note that members which are the same as those in the first embodiment described above are assigned identical reference signs and numerals, and redundant descriptions will be omitted.

As shown in FIG. 6, a retaining portion 61B of this embodiment is provided integrally on the surface of the upstream flow path member 30 side of a downstream flow path member 40A. In other words, the retaining portion 61B that has a cylindrical shape is provided on the outer circumferential side of the second protruding portion 41 integrally with a downstream flow path member 40A.

In the same manner as in the first embodiment described above, the retaining portion 61B and the seal member 50 contact or do not contact one another in a state in which the ink is not pressurized, and are closely adhered to one another when the ink is pressurized.

Even in this configuration, it is possible to suppress the leaking out of the pressurized ink in the same manner as in the first embodiment described above.

In this embodiment, since the retaining member 60 is not provided, the upstream flow path member 30 may be directly fixed to the downstream flow path member 40A. Incidentally, even if the upstream flow path member 30 is directly fixed to the downstream flow path member 40A, as long as the seal member 50 is not interposed between the upstream flow path member 30 and the downstream flow path member 40A while applying a pressure in the third direction Z, a pressure will not be applied to the recording head 10 in the third direction Z.

OTHER EMBODIMENTS

Each of the embodiments of the invention are described above. However, the general configuration of the invention is not limited to those described above.

For example, in the first to third embodiments described above, the seal member 50, in which a plurality of the pipe-shaped portions 51 are provided integrally, is exemplified; however, the invention in not particularly limited thereto and independent pipe-shaped portions may be provided for each of the upstream flow paths 101.

In the first to third embodiments described above, the upstream flow path member 30 is configured of the three members of the first upstream flow path member 31, the second upstream flow path member 32 and the third upstream flow path member 33; however, the upstream flow path member 30 may be formed of a single member, and may be configured of a plurality of members other than three. In the same manner, in the examples described above, the downstream flow path members 40 and 40A are configured of a single member; however, the invention is not particularly limited thereto, and may be configured of a plurality of two or more members.

In the first and second embodiments described above, the retaining portion 61 is provided on the retaining member 60; however, the invention is not particularly limited thereto, and the retaining portion 61 may be provided as a portion of the upstream flow path member 30.

In the first to third embodiments described above, the retaining portions 61 to 61B are provided to continue across the outer circumferences of the pipe-shaped portions 51 in the circumferential direction; however, the invention is not particularly limited thereto, and the retaining portions 61 to 61B may be provided intermittently on the pipe-shaped portions 51 in the circumferential direction. In other words, slits may be provided at a predetermined interval in the circumferential direction on the retaining portions 61 to 61B. That is, "the retaining portions 61 to 61B are provided along the outer circumferences of the pipe-shaped portion 51" includes the retaining portions being provided continually along the outer circumferences of the pipe-shaped portions 51 and intermittently along the outer circumferences of the pipe-shaped portions 51.

In the first and third embodiments described above, the retaining portions 61 and 61B are provided to extend to a region in which the retaining portion and the gap between the first protruding portion 36 and the second protruding portion 41, oppose one another. However, the invention is not particularly limited thereto, and it is possible to realize the same effects as the first and third embodiments described above even if the retaining portions 61 and 61B are provided only on a region in which the retaining portion and the second protruding portion 41 oppose one another.

Figure 7:
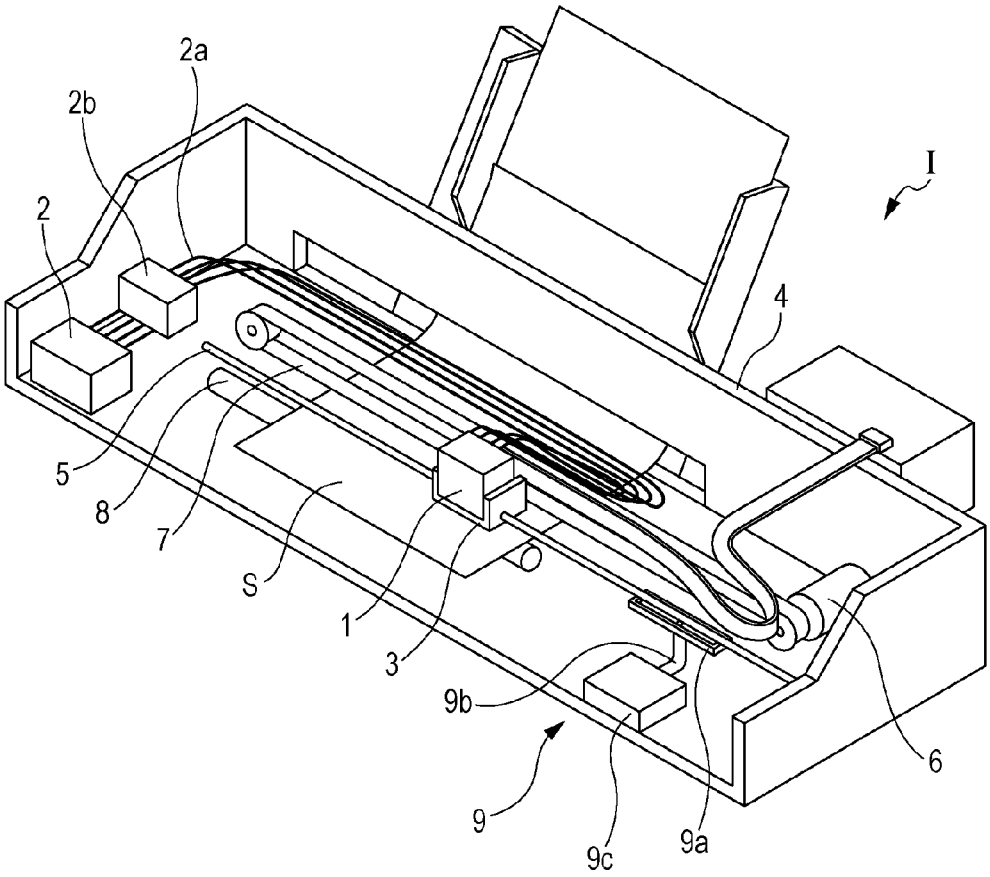
FIG. 7 is a perspective view showing the schematic configuration of a recording apparatus according to an embodiment of the invention.

The ink jet recording head unit 1 of each embodiment described above is mounted on an ink jet recording apparatus. FIG. 7 is a schematic view showing an example of the ink jet recording apparatus.

In an ink jet recording apparatus I shown in FIG. 7, the head unit 1 is mounted on a carriage 3, and the carriage 3 is provided on a carriage shaft 5, which is attached to an apparatus body 4, to move freely in an axial direction.

The carriage 3 to which the head unit 1 is mounted moves along the carriage shaft 5 due to the driving force of a drive motor 6 being transmitted to the carriage 3 via a plurality of gears (not shown) and a dynamic belt 7. Meanwhile, in the apparatus body 4, a platen 8 is provided along the carriage shaft 5, and a recording sheet S, which is a recording medium such as paper that is fed by a paper feed roller or the like (not shown), is wound around the platen 8 and transported.

The ink jet recording apparatus I is provided with a liquid holding portion 2, which is fixed to the apparatus body 4 and ink is stored on an inner portion thereof. A supply pipe 2*a* that is formed of a pipe-shaped portion such as a flexible tube, which is provided with a supply path that supplies the ink to the head unit 1, is connected to the liquid holding portion 2.

A pressure pump 2*b*, which is the pump unit that pumps the ink of the liquid holding portion 2 to the head unit 1, is provided part way down the supply pipe 2*a*. The ink of the liquid holding portion 2 is supplied to the head unit 1 with a predetermined pressure by the pumping of the pressure pump 2*b* due to the pressure pump 2*b* being driven at a predetermined timing.

A cleaning unit 9, which sucks the ink, the bubbles or the like within the flow path from the nozzles of the head unit 1, is provided on a non-print region of the ink jet recording apparatus I.

The cleaning unit 9 includes a cap member 9*a* that covers the nozzles of the head unit 1, and a suction unit 9*c* such as a vacuum pump that is connected to the cap member 9*a* via a suction tube 9*b*.

In the cleaning unit 9 of this configuration, the cap member 9*a* is caused to abut the liquid ejecting surface 12 of the head unit 1, the inner portion of the cap member 9*a* is set to a negative pressure by causing the suction unit 9*c* to perform a suction operation, the ink within the flow path is sucked from the nozzles together with bubbles and a suction operation (cleaning) is performed. When not performing printing, the drying of the nozzle may be suppressed by sealing the nozzle using the cap member 9*a*.

The cap member 9*a* abuts the liquid ejecting surface 12 on which the nozzles are open at a predetermined timing, in this embodiment, since the cap member 9*a* covers the nozzles, the cap member 9*a* is provided to move freely in the third direction Z. The movement of the cap member 9*a* may be performed using a movement unit such as a drive motor or an electromagnet (not shown).

In the ink jet recording apparatus I, with the increase in nozzle density of the head unit 1, it is difficult to reliably suck the ink within the flow paths of the head unit 1 using just the suction power of the suction unit 9*c*. Therefore, when the ink within the flow paths is sucked from the nozzles by the cleaning unit 9, the ink that is supplied from the liquid holding portion 2 side is pressurized by the pressure pump 2*b*. At this time, the ink within the head unit 1 is pressurized as described above; however, it is possible to suppress the leaking out of the ink during the pressurization of the ink by providing the retaining portions 61 to 61B on the head unit 1, as described above in the first to third embodiments.

The pressurization of the ink within the head unit 1 is not limited to just the cleaning operation or the like. For example, in a case in which a valve (a negative pressure valve) that communicates the upstream and the downstream when the pressure of the downstream side on the inner portion of the downstream flow path members 40 and 40A is a negative pressure is provided, the ink may be supplied from the liquid holding portion 2 in a state of always being pressurized by the pressure pump 2*b*.

In the embodiments described above, a flow path member 20 is exemplified that includes the upstream flow path member 30 that is provided with the upstream flow path 101 and the downstream flow path member 40 that is provided with the downstream flow path 102; however, when the ink (the liquid) is caused to circulate, the upstream and the downstream may be reversed. In other words, the ink that is supplied to the recording head 10 may be caused to flow from the downstream flow path 102 to the upstream flow path 101 and be drained (circulated) to the liquid holding portion 2 or a storage unit in which drained ink is stored.

In the ink jet recording apparatus I described above, a configuration is exemplified in which the head unit 1 is mounted on the carriage 3 and moves in the main scanning direction. However, the invention is not particularly limited thereto, and, for example, may also be applied to a so-called line recording apparatus, in which the head unit 1 is fixed and printing is performed by only causing the recording sheet S such as the paper to move in the sub-scanning direction.

In the examples described above, a configuration is exemplified in which the liquid holding portion 2 is fixed to the apparatus body 4; however, the invention is not particularly limited thereto, and an ink cartridge or the like may be directly mounted on the carriage 3. For example, the liquid holding portion may not be mounted on the ink jet recording apparatus I.

Furthermore, the invention widely targets liquid ejecting head units in general. For example, the invention can be applied to a liquid ejecting head unit which has recording heads such as a variety of ink jet recording heads that are used in an image recording apparatus such as a printer, a color material ejecting head, which is used in the manufacture of color filters of liquid crystal displays and the like, an electrode material ejecting head, which is used in the electrode formation of organic EL displays, Field Emission Displays (FED) and the like, and a biogenic and organic matter ejecting head, which is used in the manufacture of biochips.

The entire disclosure of Japanese Patent Application No. 2013-126894, filed Jun. 17, 2013 is expressly incorporated by reference herein.

What is claimed is:

1. A liquid ejecting head unit comprising:

a liquid ejecting head that discharges a liquid from a nozzle by driving a pressure generating unit;

an upstream flow path member that includes an upstream flow path to which a liquid is supplied from a liquid holding portion that holds the liquid;

a downstream flow path member that includes a downstream flow path that communicates with the upstream flow path of the upstream flow path member and supplies the liquid to the liquid ejecting head;

a seal member that includes a pipe-shaped portion, which connects the upstream flow path of the upstream flow path member to the downstream flow path of the downstream flow path member and is provided with a connecting flow path through which the liquid flows, and is formed of an elastic material; and a retaining portion that is provided along an outer circumference of the pipe-shaped portion, wherein the pipe-shaped portion seals the connecting flow path with inner walls thereof abutting at least one of the upstream flow path member and the downstream flow path member, and wherein the retaining portion is configured to abut the pipe-shaped portion at a part where the pipe-shaped portion abuts at least one of the upstream flow path member and the downstream flow path member.

2. The liquid ejecting head unit according to claim 1, wherein the part at which the retaining portion abuts the pipe-shaped member is retained such that the liquid does not leak out from a connecting portion between the upstream flow path member and the downstream flow path member due to the liquid being pressurized within the connecting flow path.

3. A liquid ejecting apparatus comprising:

the liquid ejecting head unit according to claim 2.

4. The liquid ejecting apparatus according to claim 3, further comprising a pump unit that pumps the liquid to the liquid ejecting head unit.

5. The liquid ejecting head unit according to claim 1, wherein the upstream flow path member and the downstream flow path member are disposed within the connecting flow path with a gap opened therebetween, and wherein the retaining portion is provided to extend to an outer circumference that opposes the gap.

6. The liquid ejecting head unit according to claim 1, wherein the retaining portion is provided on a retaining member that is provided between the upstream flow path member and the downstream flow path member, and wherein the retaining member and the downstream flow path member are fixed to one another at different positions from that of the nozzle when projected onto a plane on which the nozzle of the liquid ejecting head is formed.

7. The liquid ejecting head unit according to claim 1, wherein the pipe-shaped portion seals the connecting flow path with the inner walls thereof abutting both of the upstream flow path member and the downstream flow path member, and wherein the retaining portion is continuously provided across a part at which the pipe-shaped portion abuts the upstream flow path member and a part at which the pipe-shaped portion abuts the downstream flow path member.

8. A liquid ejecting apparatus comprising:

the liquid ejecting head unit according to claim 1.

9. The liquid ejecting apparatus according to claim 8, further comprising a pump unit that pumps the liquid to the liquid ejecting head unit.

10. A liquid ejecting head comprising:

a liquid ejecting head that discharges a liquid from a nozzle by driving a pressure generating unit; an upstream flow path member that includes an upstream flow path member that includes an upstream flow path to which a liquid is supplied from a liquid holding portion that holds the liquid;

a downstream flow path member that includes an upstream flow path to which a liquid is supplied from a liquid holding portion that holds the liquid;

a downstream flow path member that includes a downstream flow path that communicates with the upstream flow path of the upstream flow path member and supply the liquid to the liquid ejecting head;

a seal member that includes a pipe-shaped portion, which connects the upstream flow path of the upstream flow path member to the downstream flow path of the downstream flow path member and is provided with a connecting flow path through of which the liquid flows, and is formed of an elastic material; and a retaining portion that is provided along outer circumference of the pipe-shaped portion, wherein the pipe-shaped portion seals the connecting flow path with inner walls thereof abutting at least one of the upstream flow path member and the downstream flow path member, and wherein the retaining portion is configured to abut the pipe-shaped portion at a part where the pipe-shaped portion expands due to the liquid being pressurized within the connecting flow path.

11. The liquid ejecting head according to claim 10, wherein the part at which the retaining portion abut the pipe-shaped member is retained such that the liquid does not leak out from a connecting portion between the upstream flow path member and the downstream flow path member due to the liquid being pressurized within the connecting flow path.

12. A liquid ejecting apparatus comprising: the liquid ejecting head unit according to claim 11.

13. The liquid ejecting apparatus according to claim 12, further comprising a pump unit that pumps the liquid to the liquid ejecting head unit.

14. The liquid ejecting head unit according to claim 10, wherein the usptream flow path member and the downstream flow path member are disposed within the connecting flow path with a gap opened therebetween, and wherein the retaining portion is provided to extend to an outer circumference that opposes the gap.

15. The liquid ejecting head unit according to claim 10, wherein the remaining portion is provided on a retaining member that is provided between the upstream flow path member and the downstream flow path member, and wherein the retaining member and the downstream flow path member are fixed to one another at different positions from that of the nozzle when projected onto a plane on which the nozzle of the liquid ejecting head is formed.

16. The liquid ejecting head unit according to claim 10, wherein the pipe-shaped portion seals the connecting flow path with the inner walls thereof abutting both of the upstream flow path member and the downstream flow path member, and wherein the retaining portion is continuously provided across a part at which the pipe-shaped portion abuts the upstream flow path member and a part at which the pipe-shaped portion abuts the downstream flow path member.

17. A liquid ejecting apparatus comprising: the liquid ejecting head unit according to claim 10.

18. The liquid ejecting apparatus according to claim 17, further comprising a pump unit that pumps the liquid to the liquid ejecting head unit.

* * * * *